US009285177B1

(12) United States Patent
Chachamian et al.

(10) Patent No.: US 9,285,177 B1
(45) **Date of Patent: *Mar. 15, 2016**

(54) SYSTEM AND A METHOD FOR PROTECTED RELOADING OF A REMOTE CONTROLLED WEAPON STATION

(71) Applicant: RAFAEL ADVANCED DEFENSE SYSTEMS LTD., Haifa (IL)

(72) Inventors: Shimon Chachamian, Haifa (IL); Eyal Berkovich, Haifa (IL); Noam Katz, Haifa (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/452,430

(22) Filed: Aug. 5, 2014

Related U.S. Application Data

(63) Continuation of application No. 13/386,244, filed as application No. PCT/IL2010/000592 on Jul. 25, 2010, now Pat. No. 8,833,228.

(30) Foreign Application Priority Data

Jul. 23, 2009 (IL) ..... 200036

(51) Int. Cl.
*F41A 9/00* (2006.01)
*F41A 9/79* (2006.01)
*F41A 9/76* (2006.01)

(52) U.S. Cl.
CPC .... *F41A 9/79* (2013.01); *F41A 9/76* (2013.01)

(58) Field of Classification Search
CPC ..... F41A 9/76; F41A 9/29; F41A 9/79; F41A 9/04; F41A 9/00; F42B 39/08; F42B 39/002
USPC ..... 89/33.01, 33.5, 33.14, 33.2
See application file for complete search history.

(56) References Cited

U.S. PATENT DOCUMENTS

| | | | | |
|---|---|---|---|---|
| 2,349,454 | A | 5/1944 | O'Hare | |
| 2,364,425 | A | 12/1944 | Corte | |
| 2,378,191 | A * | 6/1945 | Corte | 89/33.16 |

(Continued)

FOREIGN PATENT DOCUMENTS

| | | |
|---|---|---|
| WO | 2005/118295 | 12/2005 |
| WO | 2008/097255 | 8/2008 |
| WO | 2008/150356 | 12/2008 |

*Primary Examiner* — Samir Abdosh
(74) *Attorney, Agent, or Firm* — Rodney J. Fuller; Booth Udall Fuller, PLC

(57) ABSTRACT

RCWS (Remote Controlled Weapon System or Station) of the deck-penetrator type and a method for protected reloading of a weapon system that is fed by belt of rounds from an ammunition container that is positioned in the RCWS, wherein the RWCS includes a system for protected reloading of the weapons system, that comprises—a bracket, that on it the ammunition container is mounted, and the bracket is amenable to be propelled via an opening in the deck of the vehicle upon which the RCWS is positioned, unto an inner space of the carrier vehicle and back from this space to the RCWS; and means for movably positioning the bracket, in at least two states—a first state wherein the bracket is positioned inside the inner space of the carrier vehicle and for reloading anew the weapons system; and a second state wherein the bracket is a least substantially embedded in the RCWS for feeding the weapons system by a belt of rounds from inside of the ammunition container that is positioned on the bracket.

13 Claims, 8 Drawing Sheets

(56) References Cited

U.S. PATENT DOCUMENTS

Figure 1:
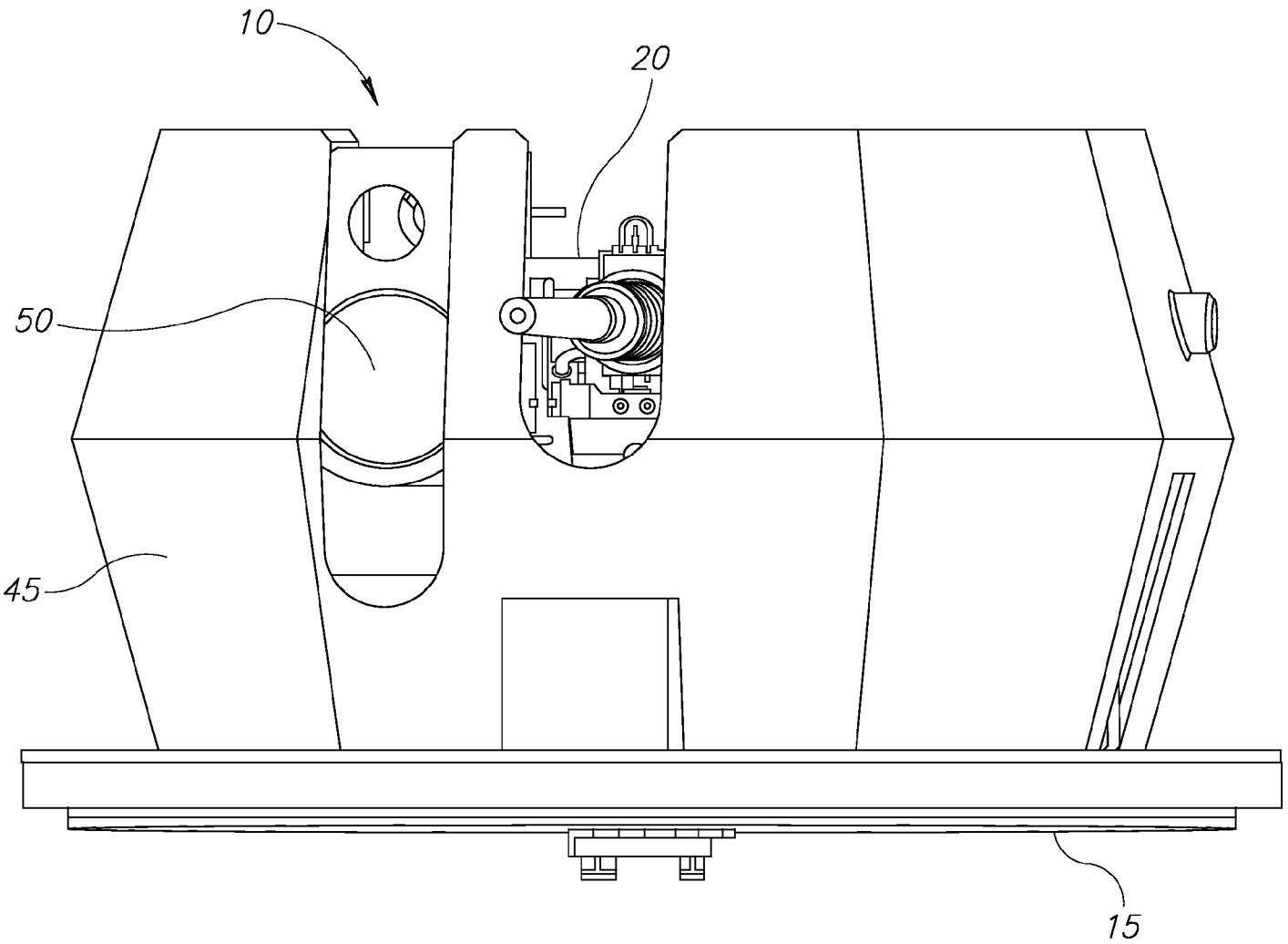

| | | | | | |
|---|---|---|---|---|---|
| 2,379,185 | A | * | 6/1945 | Reek | 89/33.16 |
| 2,391,888 | A | | 1/1946 | Carleton | |
| 2,401,762 | A | * | 6/1946 | Irasek | 89/34 |
| 2,464,689 | A | | 3/1949 | Jackson | |
| 2,573,749 | A | | 11/1951 | Wheeler | |
| 2,710,561 | A | * | 6/1955 | Dowd | 89/34 |
| 3,333,507 | A | * | 8/1967 | De Meiss | 89/36.13 |
| 4,137,820 | A | | 2/1979 | Clemens | |
| 4,281,583 | A | | 8/1981 | Pollock | |
| 4,469,005 | A | | 9/1984 | Schaulin | |
| 4,593,600 | A | | 6/1986 | Kaustrater | |
| 4,662,264 | A | * | 5/1987 | Kaustrater | 89/33.1 |
| 4,982,650 | A | | 1/1991 | Bender-Zanoni | |
| 5,245,908 | A | * | 9/1993 | Sanderson | 89/34 |
| 5,949,015 | A | | 9/1999 | Smith | |
| 6,742,436 | B2 | * | 6/2004 | Grange et al. | 89/46 |
| 6,769,347 | B1 | | 8/2004 | Quinn | |
| 7,293,493 | B2 | | 11/2007 | Persson | |
| 7,546,794 | B1 | | 6/2009 | Sarles | |
| 2002/0170420 | A1 | | 11/2002 | Falk | |
| 2008/0289485 | A1 | * | 11/2008 | Quinn et al. | 89/1.1 |

* cited by examiner

SYSTEM AND A METHOD FOR PROTECTED RELOADING OF A REMOTE CONTROLLED WEAPON STATION

CROSS-REFERENCE TO RELATED APPLICATIONS

This application is a continuation of U.S. patent application Ser. No. 13/386,244, filed Jan. 20, 2012 (published as U.S. Publication No. 20120186423), which is the U.S. National Stage of International Application No. PCT/IL2010/000592, filed Jul. 25, 2010, which claims the benefit of and priority to Israeli Patent Application No. 200036, filed Jul. 23, 2009, the contents of each of which are expressly incorporated in their entireties.

FIELD OF THE INVENTION

The present invention relates to the field of Remote Controlled Weapon Systems or Stations (hereinafter—RCWS) in general, and to RCWS entities that are deck penetrating locatable over a hatch (an opening) that exists in an inner space of a vehicle or a structure that is intended to carry the RCWS (for example—over a hatch existing in the roof of an armored vehicle) in particular.

BACKGROUND OF THE INVENTION

RCWS is a remotely controlled weapon station for light and medium caliber weapons which can be installed on any type of vehicle or other platforms (land and sea-based). Such equipment is used on modern military vehicles, as it allows a gunner to remain in the relative protection of the vehicle. It may also be retrofitted onto existing vehicles.

A typical RCWS enables a variety of devices to be operated automatically or by remote control, including such as a 5.56 mm, 7.62 mm, and 12.7 mm machine guns, as well as a 40 mm automatic grenade launchers, anti-tank missiles and even observation pods. Such an RCWS is designed for example, to be mounted on light-armored, high-mobility military vehicles and to be operated by a gunner or vehicle commander operating under-the-deck.

For further knowledge about RCWS see for example U.S. Pat. No. 5,949,015, U.S. Pat. No. 6,769,347 and U.S. Pat. No. 7,293,493 and International patent application publication WO2005/118295.

A typical RCWS is mounted with a barrel weapon (one or more), which is fed—as for its ammunition, by employing a "belt of rounds/cartridges system".

Ammunition belts consist of a long string of cartridges fastened together with pieces of canvas, or, more often, attached by small metal links. Guns that use this sort of ammunition have a feed mechanism driven by the recoil motion of the bolt. This system lets one fire continuously, without reloading. Theoretically, one could form ammunition belts of any length, and verily they are a great means for providing a continuous supply of ammunition. The problem is that the belt is fairly cumbersome, and there exists a relatively high likelihood of the feed mechanism being jammed.

Hence, in order to reduce the possibility of the feed mechanism being jammed, it is customary to store the long belts of rounds (bullets) in a metal, dimensionally suitable ammunition container cases (boxes) that are located as near as possible in the immediate proximity (vicinity) of the weapon. Such a container might contain hundreds and even a thousand and more rounds. Ammunition containers constitute the most common "feeding" source for weapons that are installed in RCWS.

Further information regarding the usage of an ammunition container in the form of an enclosure for holding a supply of ammunition in a belt form associated with an RCWS is found for example in International patent application publication WO2008/097255.

Two highly challenging tasks in the RCWS domain stem from the selected method of feeding by using the long belts of bullets and in addition from he fact that by its inherent definition, the RCWS is not manned by an attending adjacent operator that is capable to discern in due time when the amount of ammunition in the box (i. e., the ammunition container) is diminishing and to tend to the task of replenishing the reduced ammunition stock being fed.

The first task is the need to receive an earlier indication regarding the fact of the diminishing ammunition quantity in the container (ammunition box) and the second task is the need to replenish it, hence the need to start refilling—subject to and around the time that such an indication is received.

As per receiving such an advanced indication as stated, there are known suitable sensor devices that warn in time—before it is too late, regarding the diminishing ammunition belts state that is becoming smaller and disappears from the ammunition box. Mostly attention is given and talked about a sensor that senses as the ammunition belt passes next to it and "translates" the sensing to a quantitative value, wherein upon producing this (worked up) value (quantity) of the ammunition in the box the sensor generates the indication about approaching need to replenish and reload anew the box.

There is a variety of sensor device technologies that are described, for example in the publication of International patent application WO2008/150356 and see there, also (within the framework of Description of Related Art chapter), the detailed particulars of prior art references related to devices for detecting the firing of rounds from a gun.

As to the second task—from the instant an that indication warning against the reduction of the round's belt that is progressively being used up from the ammunition container box, renewed loading might be performed, for example through a physical harnessing of the end extension of the residual long belt of rounds that was left in the ammunition container box to the front end part of a "fresh" long belt of rounds found in a new ammunition container. A new container that is positioned in the place and as a substitute to the "old" one (or by loading the "old" one with the new belt of rounds whose front end was harnessed as said, to the end extension of the remainder belt of rounds that was left).

The catch is that such an activity requires the dangerously exposure of the combatant whose task it is to renew the stock of the ammunition in the RCWS. He will be forced to exit the relative shelter that he gained by the position of the RCWS over the place in which he was (for example, within the existing inner space of the armored combat vehicle) and at a distant from it. Such an exposure for accomplishing the task of reloading the ammunition container box, might last for a substantial long time so that it endangers the combatant.

In RCWS that are of the deck-penetrators type, namely RCWS that might be positioned over an existing opening in the carrier vehicle, (for example—over the opening of an existing hatch in an armored combat vehicle), there are implemented nowadays two feasible solutions in this respect, and each of them is "endowed" by their respective disadvantages.

A first feasible solution is embodied by a relatively spaced geometric design of the RCWS, in a manner that enables a combatant to stand from inside the carrier vehicle and through the opening existing in the deck (the existing opening over it the RCWS is located), unto the midst of the weapon systems that are mounted in the RCWS, in order to perform the reloading activities.

Naturally, what is considered is a solution that dictates assigning a considerable free space within the RCWS. A space to be utilized and occupied only at the periods wherein the reloading anew of the ammunition container is executed (it must be remembered, that the goal is to prevent the unacceptable habit forming act of having a combatant that is as a matter of routine standing there inside the RCWS). The dedicated free space remain useless during most of the time and as said, would lead to the unnecessary wrong habit wherein a combatant stands there, within the RCWS, all the time—just the opposite of what we wanted to achieve by implementing the RCWS.

The required volume also brings about an unwholesome and not wanted result of increasing the dimensions of the RCWS and its vulnerable increased silhouette. Alternatively, if it is a must—or is desired, to maintain the RCWS dimensions as small as it can—such solution requires assigning important volume on account of the ability to equip the RCWS with one more weapons system and/or reconnaissance pod.

The second known solution is the installation of remote loading systems—namely mechanical mechanisms for remote feeding of the weapons systems. In RCWS of the deck-penetrator type, it is feasible to form a lower level (a sort of a "turret basket") that penetrates from the existing opening of the carrier vehicle (for example, the hatch opening in an armored combat vehicle) all the way into the interior of the carrier vehicle. The "turret basket", in which there are installed various mechanisms as said, feeds the weapon systems that are located in the upper of the RCWS. As the ammunition quantity decreases, it is feasible to replenish and renew the ammunition stock inside the "turret basket"—thus renewing the stock from inside a relatively sheltered space (as this operation is carried out, as said, in the relatively sheltered lower level, into which the "turret basket" of the RCWS penetrates).

Naturally, mechanical mechanisms for remote feeding of weapon systems are relatively cumbersome. In most cases, it becomes necessary to actively assist the advancement of the belt of rounds in motion to move from the lower level unto the upper level of the RCWS, because the capability of the belts for self propulsion (pull itself up) as is the situation in weapon systems, is limited. In addition, in such mechanical mechanisms for remote feeding of weapon systems, it is required to ensure accurate and smooth routing (guiding) of the belts of rounds, without any bends, twists or superfluous bends. As a consequence of the complexity of these ammunition feeding systems, naturally also the probability for the occurrence of malfunctions in their operation is increased.

The existence (in the inner volumes of the vehicles, for example) of such mechanical mechanisms for remote feeding of weapon systems also mandate the necessity to assign an otherwise free volume inside the inner space of the carrier vehicle in order to accommodate said "turret basket". Note that this is an important (dear) volume wherein, for example, on installing an RCWS equipped with a "turret basket" as said, i. e. above the combatants compartment in an armored combat vehicle—a substantial volume from the free space of the compartment would be detracted—and this when that volume is small and congested already without it. It is also to be remembered that we are talking about active mechanisms, on whose account all kinds of movements are conducted, (for example advancing said belts of rounds or the revolving motion of the turret), that naturally present a certain threat and safety danger to the combatants staying in the crammed small compartment in the immediate proximity of the "turret basket".

Thus, due to the disadvantages found in the known prior art as we did point at above, at the times and periods that preceded the present invention, it was evidently found out that there exists a need to develop, an answer to the challenge of ammunition reloading of the weapon systems in a RCWS of the deck-penetrator type, namely RCWS that are to be located above the existing opening in the carrier vehicles (for example above the hatch opening of an armored combat vehicle), wherein the following would be provided— a. Enable reloading weapon systems that are mounted in an RCWS—
   - a1. Without excess exposure of the combatants.
   - a2. Without the necessity to assign a relatively large portion of mission volume inside the RCWS.
   - a3. Without requiring a constant assignment of a relatively large volume inside the inner space of the vehicle carrying the RCWS.
b. That it will be relatively low priced and simple to manufacture, install and operate, and as much as practicable be immune to malfunctions and faults.
c. That it would be amenable to interface simply and conveniently with a variety of existing and planned platforms, that enable installing RCWS of the deck-penetrator type on them.

SUMMARY OF THE INVENTION

The present invention, the subject matter of the following patent application, successfully treats (and answers) the needs that we have pointed above, by offering a protected reloading system.

The system for protected reloading that is the subject matter of the present invention, is adapted to be installed in RCWS of the deck-penetrator type for executing protected reloading as said, of a weapons system that is fed by belts of rounds (for example a weapons system of the machine gun type, a small caliber (relatively) automatic (weaponry) cannon or a grenades launcher), from within the inner space of the ammunition container box that, as usual, is substantially located in the RCWS.

The system, the subject matter of the present invention, is characterized by that that it includes a bracket on which the ammunition container case of the weapons system is mounted. The bracket is movable (can be propelled) through the opening in the deck of the carrier vehicle—the vehicle on which the RCWS is mounted, into the inner space of the vehicle and from the inner space of the vehicle back to the RCWS.

In addition, the system includes means for movable positioning of the bracket, as said, at least in two states. The first state—positioning the movable bracket within the inner space of the carrier vehicle for the operation of replenishing (reloading) the weapons system, namely—within the relatively protected (shielded) inner space of the carrier vehicle and for physically harnessing the residual extended end of the belt of rounds to the front end of a new (fresh) belt (i. e., reloading state). The second state constitutes—basically, positioning the moveable bracket at least substantially in the RCWS for the task of feeding the weapons system by the belt of rounds from within the ammunition container box that is mounted on the bracket (i. e., regular state).

In another added and different aspect of the system, a system for protected reloading in accordance with the invention, it does implement—in the manner of its operation, a general method for protected reloading of a weapons system that is fed by belts of rounds from an ammunition container box that is positioned in an RCWS of the deck-penetrator type.

A method that includes the following steps:

Positioning an ammunition container box on a bracket that is movable for motion through the opening in the deck of the carrier vehicle, namely the vehicle that on which the RCWS is positioned, into the inner space of the carrier vehicle and back from said inner space of the carrier vehicle to the RCWS.

A step of receiving an indication about the diminishing state of the rounds from within the ammunition container.

A step of propelling the bracket and positioning it in the renewed reloading state—within the inner space of the carrier vehicle, and in a manner that it becomes possible to physically harness the residual end of the (used) belt of rounds to the protruding front end of a new belt and to accomplish it at least substantially within the protected inner space of the carrier vehicle.

A step of physically harnessing the residual end of the (used) belt of rounds to the protruding front end of a new belt (a harnessing activity that is executed, as said, at least substantially within the relatively protected inner space of the carrier vehicle); and—

A step of propelling the bracket and positioning it back so that the ammunition container is a least substantially within the RCWS.

BRIEF DESCRIPTION OF THE ACCOMPANYING DRAWINGS

An example of the present invention will be described hereinafter in conjunction with the accompanying figures. Identical components, wherein some of them are presented in the same figure—or in case that a same component appears in several figures, will carry an identical number.

FIG. 1. constitutes a general view illustration of an example of an RCWS of the deck-penetrator type, of the kind in which it is feasible to install a system for protected reloading in accordance with the invention.

Figure 2:
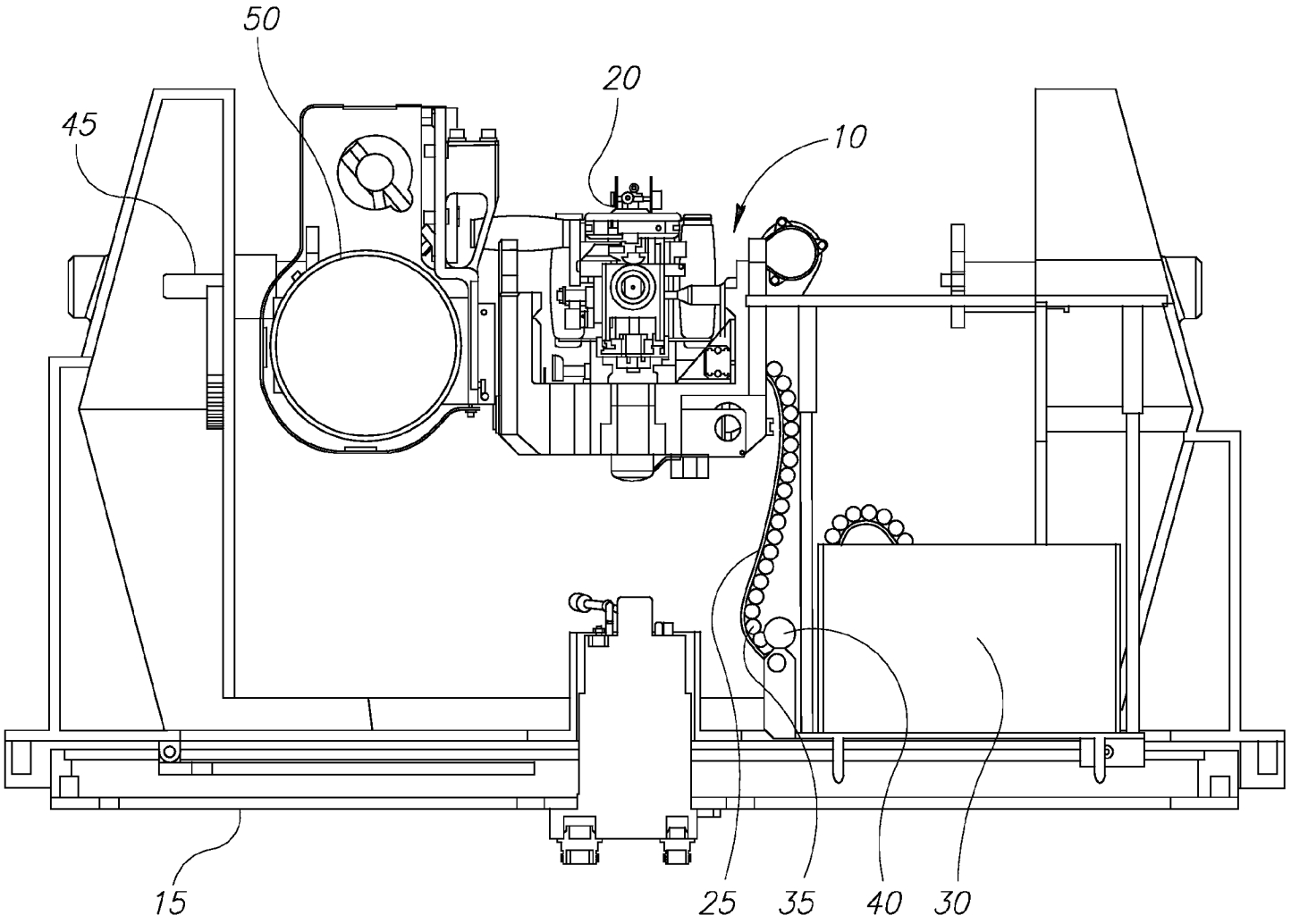

FIG. 2. constitutes a view of the RCWS example that is illustrated in FIG. 1, without some of the armor plates and in a manner that it provides familiarization with characteristic means that are installed in such an RCWS.

Figure 3:
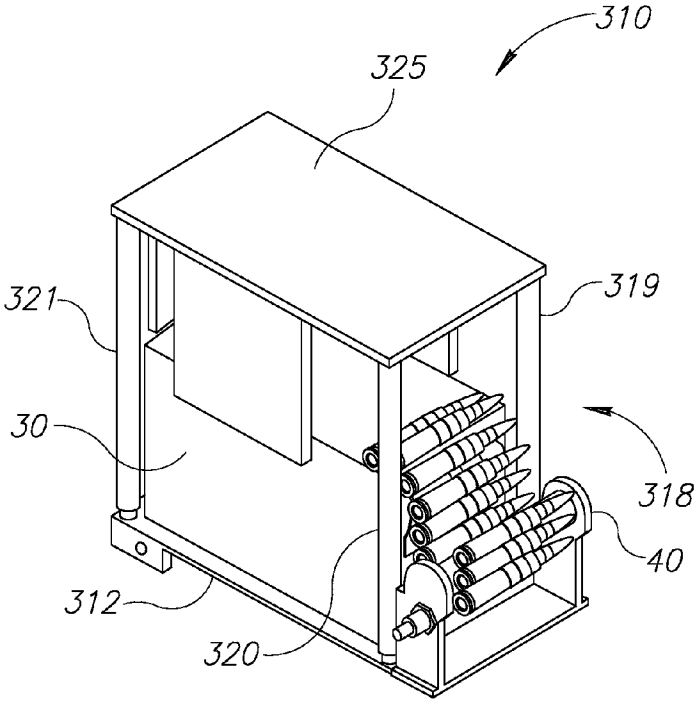

FIG. 3. constitutes a perspective view of a system for protected reloading in accordance with the invention, wherein it is found in its regular state.

Figure 4:
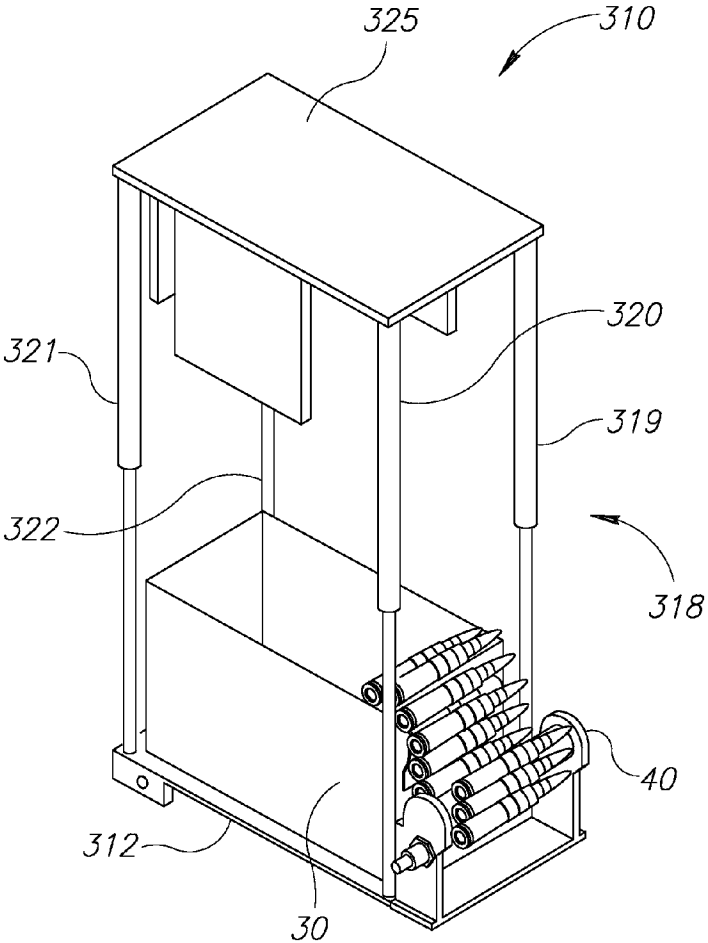

FIG. 4. constitutes a perspective view of the system for protected reloading in accordance with the invention as it is illustrated in FIG. 3, wherein it is in its reloading state (ammunition replenishing).

Figure 5:
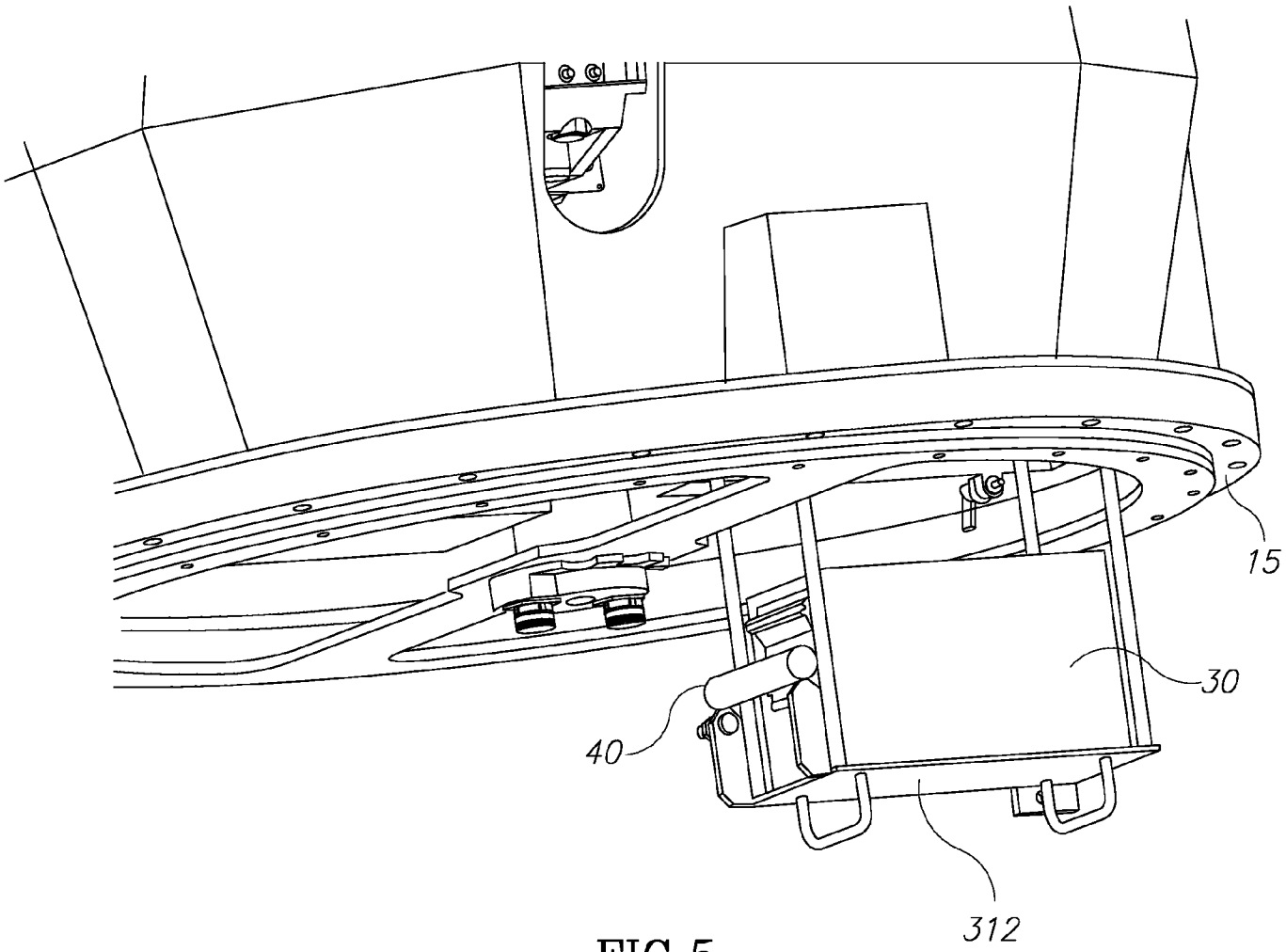
Figure 6:
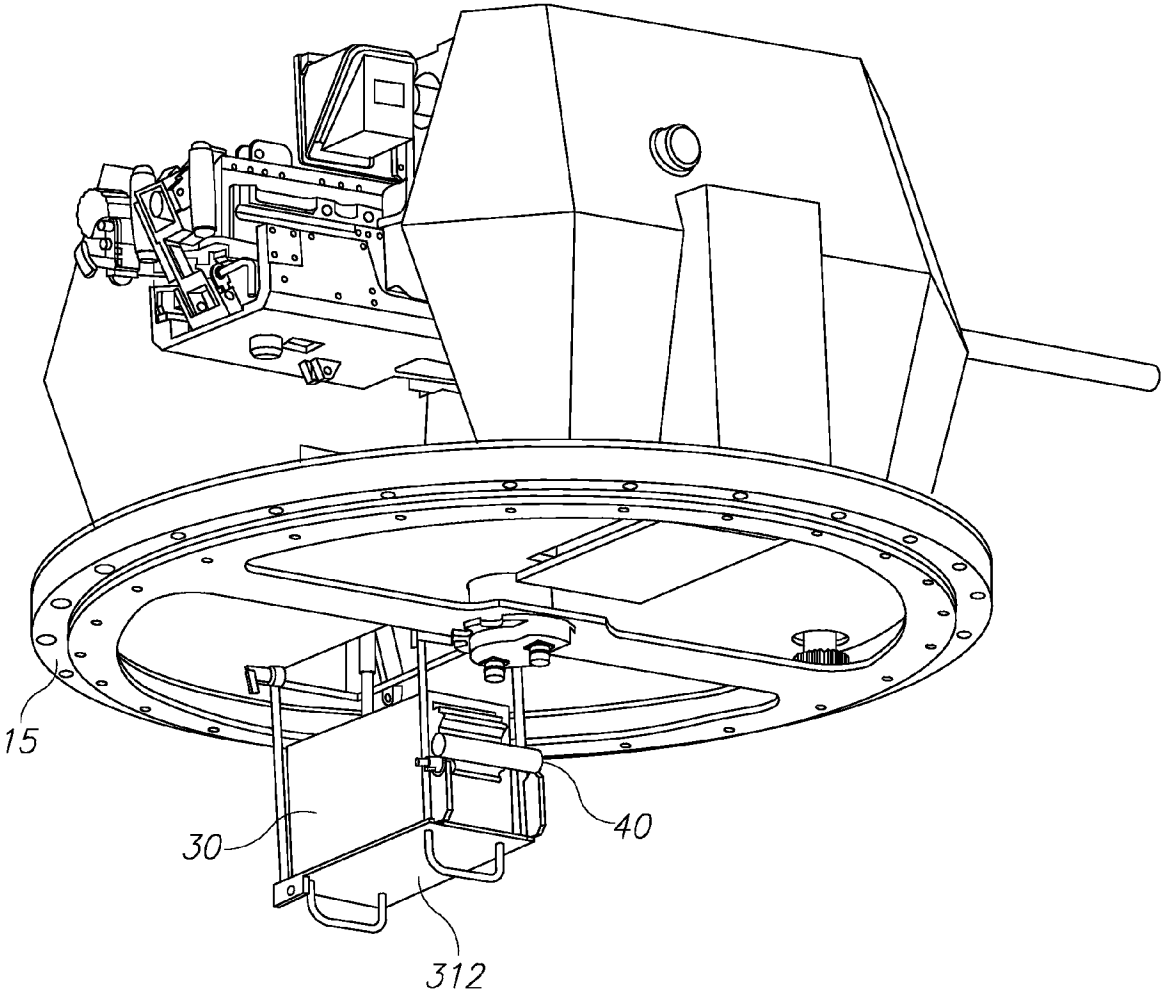

FIGS. 5 and 6. constitute perspective views of the example system for protected reloading in accordance with the invention as it is illustrated in FIGS. 3 and 4, wherein the system is installed in an RCWS and is situated in the reloading state.

Figure 7:
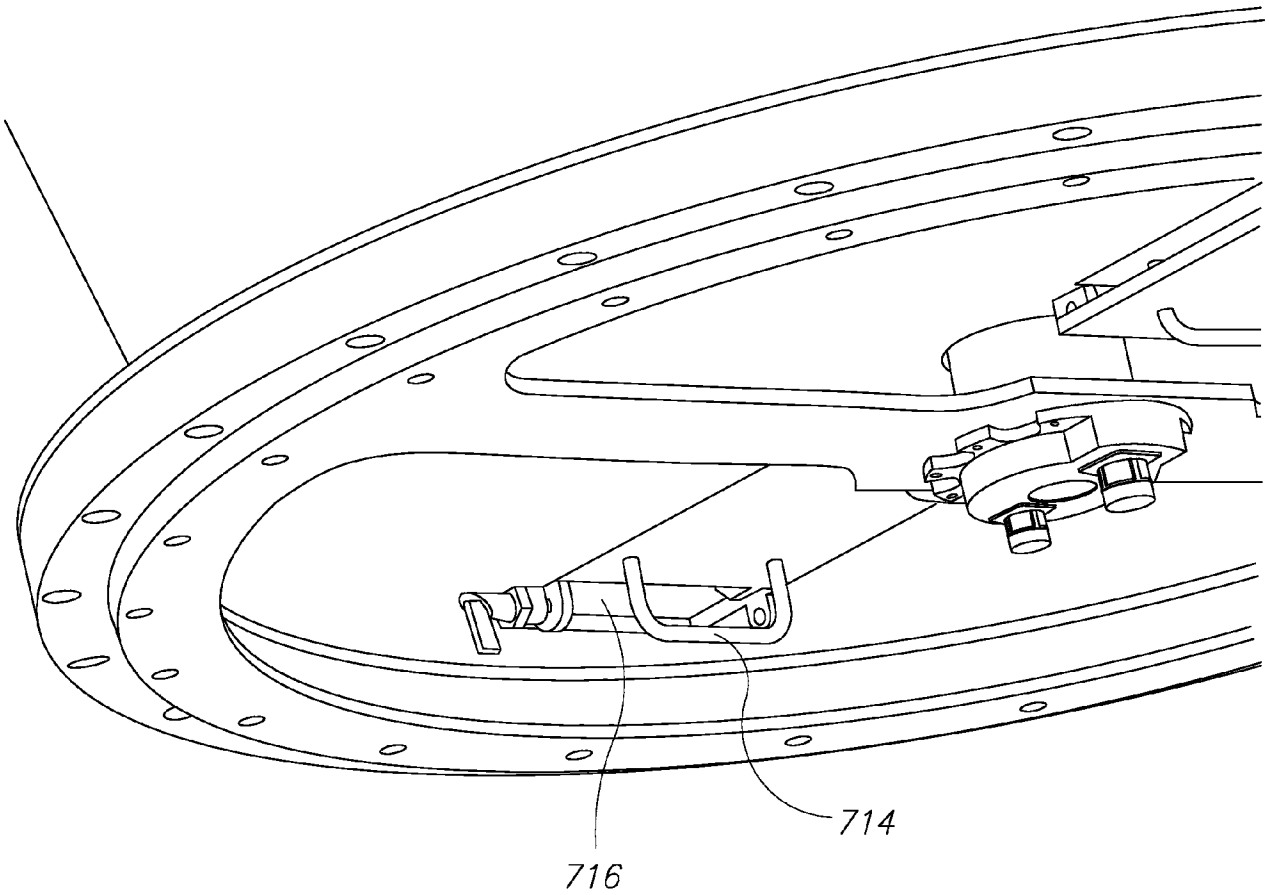

FIG. 7. constitutes a perspective view of the example system for protected reloading in accordance with the invention as it is illustrated in FIGS. 3 and 4, wherein the system is installed in an RCWS and is situated in its regular state—embedded within the RCWS.

Figure 8:
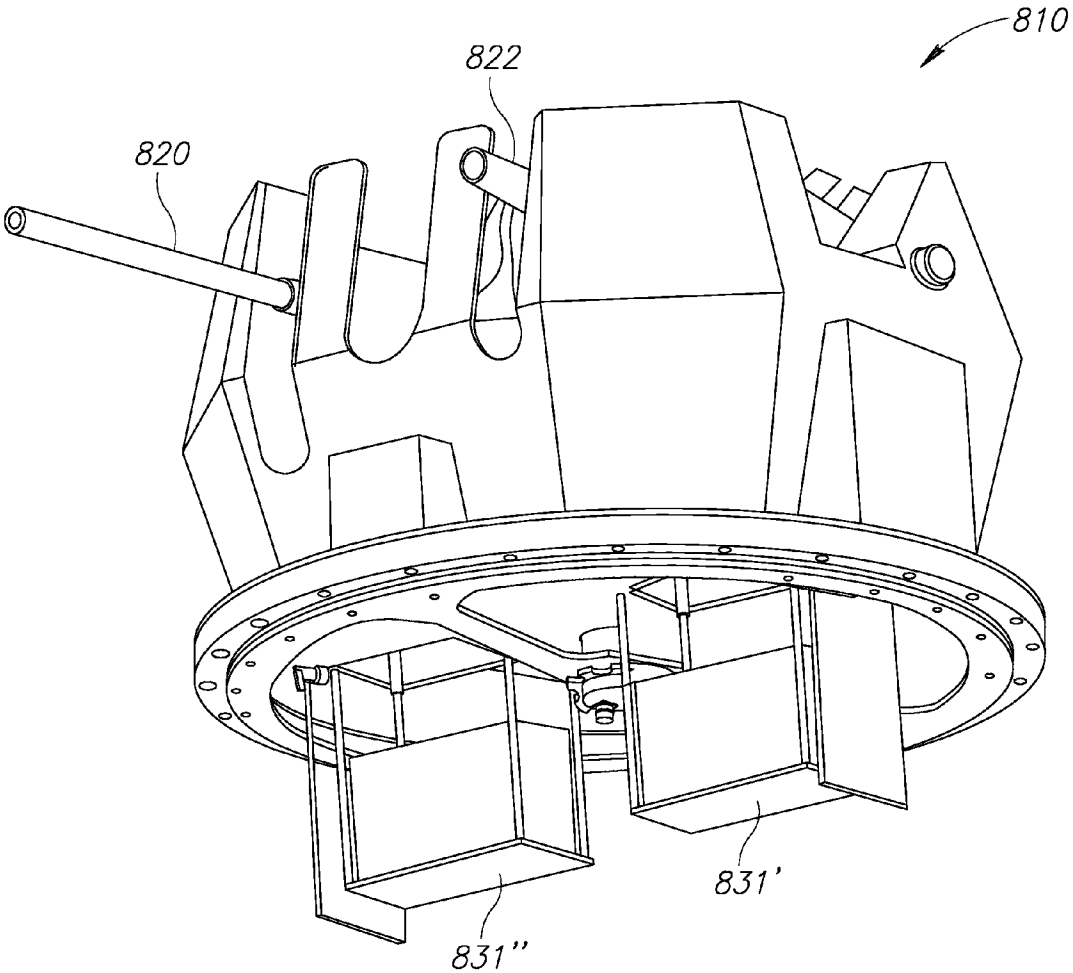

FIG. 8. constitutes a general view of an additional example of an RCWS of the deck-penetrator type, of the kind in which two (2) weapon systems are installed, wherein each one for itself is amenable to be subjected to protected reloading by a system in accordance with the invention, as in the example system whose components are illustrated in FIGS. 3 and 4, and wherein the systems for reloading (ammunition replenishing) in accordance with the invention are illustrated as they are in the reloading states.

Figure 9:
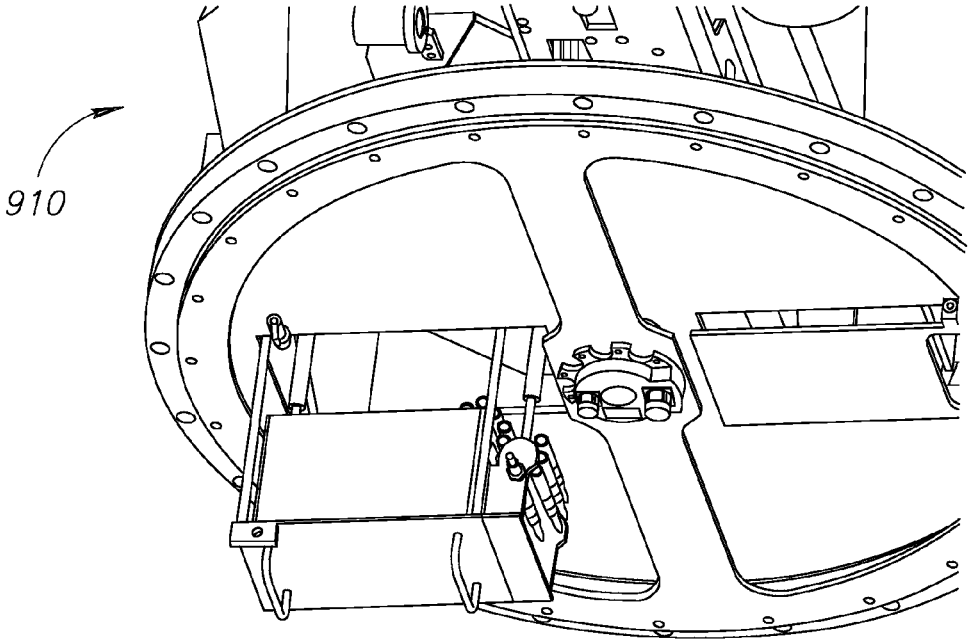

FIG. 9. constitutes a view in perspective of an RCWS, where similarly to that illustrated in FIG. 8, there are installed in it two weapon systems wherein each one for itself is amenable to be subjected to protected reloading by a system in accordance with the invention, as in the example system whose components are illustrated in FIGS. 3 and 4, wherein one of the systems for protected reloading in accordance with the invention, is in the reloading state while the other one is shown in motion from one state to the other (second) state.

Figure 10:
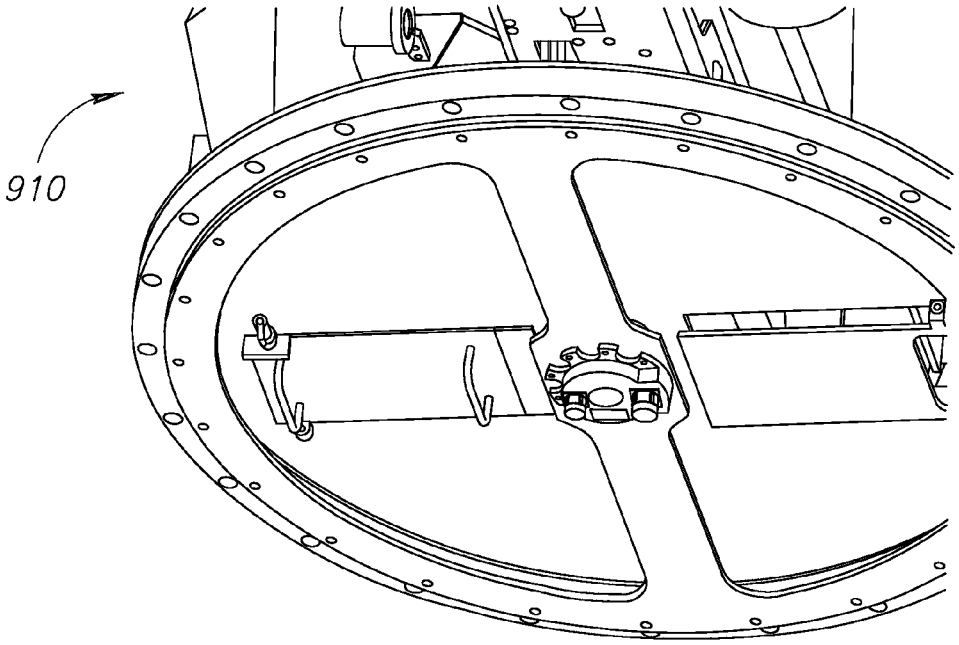

FIG. 10. constitutes a perspective view of the RCWS illustrated in FIG. 9, wherein one of the two systems for protected reloading in accordance with the invention is in the regular state (embedded in the RCWS) and the other one is in transition from one state to the other.

DETAILED DESCRIPTION OF PREFERRED EMBODIMENT OF THE INVENTION

Reference is being made to FIGS. 1 and 2. FIG. 1 constitutes a general view illustration of an example RCWS of the deck-penetrator type 10, of the kind in which it is feasible to install a system for protected reloading in accordance with the invention. FIG. 2 constitutes a view of RCWS 10 without some of its armor (protecting) plates and in a manner that it provides familiarization with characteristic means that are installed in such an RCWS.

RCWS 10 is—as said, of the RCWS of the deck-penetrator type, namely RCWS that can be positioned over an existing opening in the inner space of the carrier vehicle.

As such, RCWS 10 comprises means for connecting it unto the edge of the existing opening in the carrier vehicle. In the illustrated example—turret's ring 15 that is suited to being installed on the circumference of the existing edge of the hatch opening of an armored vehicle (those are not illustrated), while utilizing for this purpose, standard means that are recognized and well known to every professional in this field (e.g.—bolts, bearings).

RCWS 10 comprises a weapons system—such as machine gun 20 that is fed by a rounds' belt 25 from within ammunition container box 30. Ammunition container 30 is located in RCWS 10 adjacent to machine gun 20. The rounds' belt 25 is led (routed) and guided through track (path) means 35 to machine gun 20. On its way towards the machine gun, the belt of rounds 25 moves past sensor device 40. Sensor device 40 enables the issuing of an advanced indication of the fact of diminishing rounds in the rounds' belt from within the ammunition container. RCWS 10 also includes in addition protection means—materialized by armor plates 45, as well as reconnaissance means 50.

Any professional would understand that all that was described above constitutes solely a description of characteristic means that might be regularly found in such an RCWS 10, while various (different) variations might include other or additional weapon system (see for example, below, referring to FIGS. 8-10), or be formed wherein the ammunition container is positioned so that part of it protrudes outwards through an opening in the carrier vehicle (that is not illustrated) downwards into the inner space of the carrier vehicle.

Let's refer to FIGS. 3 and 4. FIG. 3 constitutes a perspective view of a system for protected reloading 310 in accordance with the invention, wherein it is found in its regular state. FIG. 4 constitutes a perspective view of system 310 wherein it is in its reloading state.

System 310 comprises bracket 312 on which the ammunition container 30 is mounted. Sensor device 40 is positioned on bracket 312. Balancing means 318, that in the illustrated example comprises an array of four gas pistons—319, 320, 321 and 322, enables controlled propulsion of bracket 312. Each one of the four gas pistons is harnessed on its one side to the RCWS 10 (through connecting flat surface 325) and on its other end (the propelling one) to bracket 312.

In order to understand the characteristics of system 310 and its mode of operation, reference is being made to FIGS. 5 to 7.

FIGS. 5 and 6 are perspective views of system 310 wherein the system is found in its state of reloading anew of machine gun 20 that is installed in RCWS 10. FIG. 7 constitutes a view of system 310 in its regular state—wherein it is embedded within RCWS 10. FIG. 6 constitutes an enlarged view of part of system 310 when the system is found in its regular state—embedded totally inside RCWS 10.

Bracket 312 is movable or in other words—capable to propel motion through the opening in the deck of the vehicle over which the RCWS 10 is positioned (the opening and the carrier vehicle are not illustrated).

Bracket 312 is capable to propel motion as said, in two opposing directions—into the inner space of the carrier vehicle (to the state illustrated in FIGS. 5 and 6), and back from that space to the RCWS 10 (to the state illustrated in FIG. 7).

Any professional would understand that in system 310, the Sensor device 40 that is positioned on bracket 312, produces indications regarding the diminishing rounds count in the belt of rounds in the ammunition container 30 (see also FIGS. 3 and 4). Said Sensor device produces warnings that might be expressed by different and diverse modes (for example—sending a message in the internal communication system of the vehicle in which the RCWS 10 is mounted, shutting down the firing ability, turning on a light bulb, and the like—audio, visual signs).

The warning indicates to a combatant, one or more, that the time for reloading is imminent. The reloading that is accomplished in system 310 after propelling bracket 312 to its position in the first state (as defined above—the reload state is illustrated in FIGS. 5 and 6). In this state, a combatant would physically harness the end extension of the residual belt of rounds 25 that was left in the ammunition container box to the front end part of a "fresh" long belt of rounds found in a new ammunition container. This mandatory activity can be accomplished in RCWS 10 in a rather relatively protected location—within the inner space of the carrier vehicle that carries RCWS 10 on (above) it.

Any professional would understand that harnessing the front end of a new (fresh) rounds' belt to the residual terminating end of old rounds belt might be executed simultaneously with exchanging the ammunition container that is located on top of the bracket with a new ammunition container, or alternatively, with including a new rounds' belt into that space of the ammunition container that became empty.

System 310 includes in addition means 714 for movably positioning and anchoring bracket 312, in either of the two states—

In the first state (the state of "anew reloading" state that is illustrated as said in FIGS. 5 and 6)—positioning bracket 312 within the inner space of said carrier vehicle and for the necessity of reloading machine gun 20, and in the second state (the regular state that is illustrated as said in FIG. 7) positioning bracket 312 wherein it is embedded inside RCWS 10 and adjacent to machine gun 20 as necessary for feeding machine gun 20 by the rounds' belt 25 from inside ammunition container 30 that is positioned on the bracket 312.

Means 714 for movably positioning and anchoring, as said, bracket 312, includes clasp means 716 for manually activating the releasable anchoring of bracket 312 at least in the second state (namely the regular state, as exemplified by FIG. 7).

Any professional would understand that clasp means 716 might be a standard structure (that is not illustrated) of a tab cocked by a spring that is suited to coupling (connecting) by slamming it with an appropriate bracket that is formed in bracket 312 (for example, a widthwise bore that is formed in bracket 312).

Any professional would understand that clasp means 716 might also enable anchoring in the first state of the two (the loading anew state that is illustrated in FIGS. 5 and 6), for example—by forming a suitable bracket on the face of the piston, for connecting by slamming with the same spring cocked tab cited above, upon the bracket approaching the end of the piston's stroke.

From the instant of manually releasing clasp means 716, balancing means 318 enables controlled and balanced propelling of the bracket through the opening in the deck of the vehicle upon which the RCWS 10 is positioned, well into the inner space of the vehicle or back from this space of the vehicle to RCWS 10.

Any professional would understand that system 310 that was described above—while referring to FIGS. 1 to 7, is solely an example and there might be manufactured similar systems for fulfilling protected reloading of weapon systems in an RCWS of the deck-penetrator type with variations (changes), for example—

A system in which—in the regular state, the ammunition container remains positioned (i. e. placed) so that it protrudes, at least partly, into the inner space of the carrier vehicle (and is not found completely embedded within the RCWS 10 proper).

A system in which the reloading state of the a weapons system still necessitates certain activity to be performed on the outside of the relatively protected space of the vehicle (for example partial lowering of the ammunition container into the vehicle's inner space, in a manner that necessitates extending hands into within the RCWS 10 and physically harnessing there the end extension of the residual long belt of rounds that was left in the ammunition container box to the front end part of a "fresh" (new) belt of rounds (found—not necessarily, in a new ammunition container).

A system in which the sensor device 40 is positioned on the RCWS 10 and not on the movable bracket.

A system in which the means for propelling the moveable bracket to move to either of the two states, is not for the combatant to manually pull or lift (as the case in the illustrated example), but rather constitutes a remotely operated means (for example—a propelling system based on a leading screw mechanism or a pneumatic or hydraulic piston, one or more).

A system in which the clasp means is amenable to be remotely operated and not only manually by a combatant (for example a clasp means operable by a solenoid), or A system wherein the balancing means is based on other and different balancing mechanisms than the gas pistons or cocked spring pistons (or on combinations thereof), for example—a spring array balancing mechanism.

Any professional would understand that, in view of the earlier presented system 310, such variations as they were presented and detailed above, or any combination of them, would not deviate from expected variations in light of the above described preferred embodiment of the invention.

All this and more—

Any professional would understand that system 310 that was described above, while referring to FIGS. 1 to 7, in a manner that it includes only one weapons system (machine gun 20) might be installed in an RCWS equipped with several weapon systems and in a manner that plurality of such systems for protected reloading are mounted in tandem in such multi-weapon system RCWS (while each system for protected reloading is dedicated for the reloading of the specific weapon system assigned to it).

Reference is being made to FIGS. 8 to 10. FIG. 8 constitutes a general view of an additional example of an RCWS of the deck-penetrator type 810 in which two (2) weapon systems are installed in tandem, namely a machine gun 820 and a grenades launcher 822.

Each one (by itself) of those two weapon systems is amenable to undergo the protected reloading as said, through a system in accordance with the invention, as presented in the example system whose components were illustrated in FIGS. 3 and 4, i. e., system 831' that enables protected reloading of machine gun 820 and system 831" that enables protected reloading of the grenades launcher 822 (note that systems 831' and 831" are both illustrated in the reloading anew (ammunition replenishing) state).

FIG. 9 constitutes a perspective view of an RCWS 910, wherein similarly to the one illustrated in FIG. 8, there are installed in it two weapon systems wherein each one for itself is amenable to be subjected to protected reloading by a system in accordance with the invention, as in the example system whose components are illustrated in FIGS. 3 and 4, wherein one of the systems for protected reloading in accordance with the invention is in the reloading state while the other one is shown in motion from one state to the other (second) state.

FIG. 10 constitutes a perspective view of the RCWS 910 illustrated in FIG. 9, wherein one of the two systems for protected reloading in accordance with the invention is in the regular state (embedded in the RCWS) and the other is in the process of transition—moving from one state to the other one.

Any professional would understand that instead of two independent systems that are positioned and operate separately, one next to the other, it is also feasible to erect one unified system that enables simultaneous mobility of the ammunition containers of all of those weapon systems installed in the RCWS.

Considering the explanations presented above while referring to the accompanying figures, any professional would understand that by utilizing a system such as system 310, there is actually embodied a general method of protected reloading of weapon systems that is fed through a belt of rounds from ammunition containers positioned in an RCWS of the deck-penetrator type.

The method includes the steps of—

Positioning an ammunition container (30 in the example provided in the drawings) on top of bracket (312) that is amenable to move via the opening in the deck of the vehicle on which an RCWS is mounted into the inner space of the carrier vehicle and back from said space to the RCWS.

A step of receiving an indication about the diminishing state of the rounds from within the ammunition container.

A step of propelling the bracket (312) and positioning it inside the inner space of the carrier vehicle in a manner that it becomes possible to harness the end extension of the residual belt of rounds that was left in the ammunition container box to the front end part of a "fresh" belt of rounds and to do this at least substantially within the relatively protected inner space of the carrier vehicle.

A step of physically harnessing the residual end of the (used) belt of rounds to the protruding front end of a new belt (a harnessing activity that is executed, as said, at least substantially within the relatively protected inner space of the carrier vehicle); and after harnessing the residual end of the belt in use to the front end of a fresh belt—

A step of propelling the bracket (312) back to its place wherein the ammunition container is at least substantially set in the RCWS.

Thus, a system and a method for protected reloading in accordance with the present invention constitute an adequate response to the challenge of reloading anew weapon systems in RCWS of the deck-penetrator type at which we pointed in the background of the invention section.

A system and a method for protected reloading in an RCWS of the deck-penetrator type that would be in accordance with the invention, enable reloading the weapons installed in the RCWS— a. without superfluous exposure of the combatants, because the harnessing of the end extension of the residual belt of rounds (in the ammunition container) to the front end part of a "fresh" belt of rounds happens at least substantially within the relatively protected space instilled by the carrier vehicle on which the RWCS is mounted and the combatant does not have to stand exposed up to the RWCS do so.

b. (also) Without the need to assign a considerable free volume within the RCWS because the propelling of the bracket on which the ammunition container is mounted necessitates to leave free only a limited path—such as a vertical "shaft" (in accordance with the illustrated example) of limited volume, just adequate to allow passage of the bracket through the opening in the deck to the RCWS and back from it c. (Also) without the necessity to assign a large, constant free volume inside the carrier vehicle upon which the RCWS is mounted, because the bracket—and on it the ammunition container—and at most the belt of rounds hanging from the RCWS) spend inside the vehicle only for short periods of time as necessary for completing the reloading activity, and then they are pushed back up and returned to their place in the RCWS, namely outside of the inner space within the carrier vehicle.

A system and a method for protected reloading of ammunition in an RCWS of the deck-penetrator type that would be in accordance with the invention are endowed by relatively simple and low costs manufacturing conditions, as well as for installation, operation and nearly immune to failures. Any professional in the field would appreciate the fact that the system and the method are to be implemented wherein known and reliable mechanical means would be used (for example—a metal bracket, springy clasp, gas pistons or spring loaded pistons).

In addition, a system and a method for protected reloading of ammunition in an RCWS of the deck-penetrator type, that would be in accordance with the invention, is amenable to be interfaced simply and with ease in a wide variety of platforms, known or planned, that enable the mounting of an RCWS of the deck-penetrator type atop of them. For example APC's (armored personnel carriers), wheeled vehicles, tanks, stationary (guards) posts, vessels, that are formed with a manned inner space and an opening that is connected to said inner space and in which an RCWS of the deck-penetrator type might be mounted.

Any professional would understand that the present invention, as it was described above while referring to the accompanying figures, was described solely in a way of presenting examples, and there might be manufactured, installed and implemented other systems and methods for protected reloading of an RCWS, that although will be different from what was described above, even while introducing changes, variations and additions, would not depart from the constructional and functional characteristics of the invention (the subject matter of this application), that are defined by the following claims.

What is claimed is:

1. RCWS (Remote Controlled Weapon System or Station) of the deck-penetrator type mountable to a carrier vehicle, comprising:

at least one weapon system that is fed by a belt of rounds from the inside of an ammunition container that is positioned, at least substantially, in the RCWS, wherein said RCWS is positioned on a turret ring that is rotatably installed on a circumference of an existing opening in a deck of the carrier vehicle;

and wherein said RCWS is characterized by that it includes in addition:

a system for protected reloading of said weapons system, that comprises:

a bracket, that on it said ammunition container is mounted, and said bracket is configured to move the bracket below said existing opening in the deck of the carrier vehicle upon which the RCWS is positioned, into an inner space of said carrier vehicle and back from said inner space to the RCWS;

wherein the bracket comprises at least one balancer configured to move the bracket between at least two states:

a first state wherein said bracket is positioned inside said inner space of said carrier vehicle and for reloading anew said weapons system; and a second state wherein said bracket is a least substantially embedded in the RCWS for feeding said weapon system by the belt of rounds from inside of said ammunition container that is positioned on said bracket and wherein said system for protected reloading of said weapons system is coupled to the rotatable RCWS and therefore enabling protected reloading of said weapons system independent of a rotational position of the RCWS.

2. RCWS in accordance with claim 1, further comprising:

a sensor device for issuing a warning regarding the diminishing of rounds in said belt; and wherein the warning identifies a necessity for propelling said bracket and positioning it in said first state location, in a manner that at this said first state it is possible to physically harness a residual extended end of said belt of rounds to a front end of a second belt of rounds, and to do so inside said inner space of said carrier vehicle.

3. RCWS in accordance with claim 2, wherein:

said sensor device is located on said bracket.

4. RCWS in accordance with claim 1, further comprising:

a clasp configured to anchor the bracket in said second state when the clasp is closed and to release the bracket into said first state when the clasp is open; and wherein the at least one balancer controls the movement of said bracket from an instant of releasing said clasp through said existing opening in the deck of said carrier vehicle upon which said RCWS is positioned, into said inner space of said carrier vehicle.

5. RCWS in accordance with claim 4, wherein each of the at least one balancer comprises:

at least one piston having a first end harnessed to the RCWS and a second end harnessed to said bracket.

6. A method for protected reloading of a weapon system that is fed by belts of rounds from an ammunition container that is positioned in an RCWS (Remote Controlled Weapon System or Station) of the deck-penetrator type mountable to a carrier vehicle, comprising:

positioning said ammunition container on a bracket that is movable through an opening in a deck of the carrier vehicle on which the RCWS is positioned, into an inner space of the carrier vehicle and back from said inner space of the carrier vehicle to the RCWS, wherein the ammunition container and the bracket are movable through the opening in the deck of the carrier vehicle independent of a rotational position of the RCWS;

receiving an indication about the diminishing state of the rounds from within the ammunition container;

propelling the bracket and positioning it in a renewed reloading state—within the inner space of the carrier vehicle, and in a manner that it becomes possible to physically harness a residual end of a used belt of rounds to a protruding front end of a new belt of rounds and to accomplish it at least substantially within the relatively protected inner space of the carrier vehicle;

harnessing the residual end of the used belt of rounds to the protruding front end of the new belt of rounds at least substantially within the relatively protected inner space of the carrier vehicle; and propelling the bracket and positioning it back so that the ammunition container is a least substantially within the RCWS.

7. A Remote Controlled Weapon System or Station (RCWS), comprising:

a revolving turret assembly rotatably installed on a circumference of an existing opening in a deck of a carrier vehicle;

a weapon system coupled to the revolving turret assembly and positioned above the deck of the carrier vehicle, and the weapon system being fed by a first belt of rounds housed within an ammunition container that is positioned in a feeding state that is at least partially above the deck;

a bracket coupled to the revolving turret assembly and coupled to the ammunition container;

at least one balancer coupled to the bracket and configured to raise and lower the ammunition container between the feeding state and a reloading state, the reloading state comprising a position where the ammunition container is positioned substantially below the deck and substantially inside an inner space of the carrier vehicle;

wherein the revolving turret assembly, the weapon system, the ammunition container, the bracket, and the at least one balancer rotate together regardless of whether the ammunition container is positioned in the feeding state or the reloading state; and whereby, when the ammunition container is positioned in the reloading state, a second belt of rounds may be harnessed to the first belt of rounds and housed within the ammunition container from within the inner space of the carrier vehicle.

8. An RCWS in accordance with claim 7, further comprising:

a sensor device configured to issue a warning regarding the diminishing of rounds in the first belt of rounds.

9. An RCWS in accordance with claim 8, wherein:

the warning identifies a necessity for lowering the ammunition container and positioning it in reloading state, so that it is possible to harness one end of the first belt of rounds to a front end of the second belt of rounds, and to do so inside the inner space of the carrier vehicle.

10. An RCWS in accordance with claim 8, wherein:

the sensor device is located on the bracket.

11. An RCWS in accordance with claim 7, further comprising:

a clasp configured to anchor the bracket in the feeding state when the clasp is closed and to release the bracket into the reloading state when the clasp is open.

12. An RCWS in accordance with claim 11, wherein:

the at least one balancer controls the movement of the bracket upon releasing the clasp, thereby moving the ammunition container through the existing opening in the deck of the carrier vehicle and into the inner space of the carrier vehicle.

13. An RCWS in accordance with claim 7, wherein each of the at least one balancer comprises:

at least one piston having a first end harnessed to the revolving turret assembly and a second end harnessed to the bracket.

* * * * *